United States Patent [19]

Dietrich et al.

[11] 4,299,154

[45] Nov. 10, 1981

[54] ELECTRONIC RHYTHM GENERATOR

[75] Inventors: Ralph N. Dietrich, Georgetown; Stephen L. Howell; John W. Robinson, both of Jasper, all of Ind.

[73] Assignee: Kimball International, Inc., Jasper, Ind.

[21] Appl. No.: 69,977

[22] Filed: Aug. 27, 1979

[51] Int. Cl.[3] ..... G10H 1/40

[52] U.S. Cl. ..... 84/1.03; 84/1.24; 84/DIG. 12

[58] Field of Search ..... 84/1.03, 1.01, DIG. 12, 84/1.24

[56] References Cited

U.S. PATENT DOCUMENTS

| | | | |
|---|---|---|---|
| Re. 29,144 | 3/1977 | Bunger | 84/1.03 |
| 3,629,480 | 12/1971 | Harris | 84/1.03 |
| 3,646,242 | 2/1972 | Okamoto | 84/1.03 |
| 3,743,757 | 7/1973 | Okamoto | 84/1.03 |
| 3,763,305 | 10/1973 | Nakada et al. | 84/1.03 |
| 3,764,722 | 10/1973 | Southard | 84/1.03 |
| 3,803,970 | 4/1974 | Hirano | 84/1.03 |
| 3,811,003 | 5/1974 | Harris | 84/1.03 |
| 3,916,750 | 11/1975 | Vetrecht | 84/1.03 |
| 4,058,043 | 11/1977 | Shibahara | 84/1.03 |
| 4,089,245 | 5/1978 | Dietrich | 84/1.03 |
| 4,207,792 | 6/1980 | Hoskinson | 84/1.01 |

*Primary Examiner*—J. V. Truhe
*Assistant Examiner*—Forester W. Isen
*Attorney, Agent, or Firm*—Albert L. Jeffers; John F. Hoffman

[57] ABSTRACT

An electronic rhythm generator which comprises a large read only memory having a plurality of rhythm patterns and rhythm break patterns programmed therein, player operated selector switches for selecting a rhythm pattern and a break pattern, scanning circuitry for sequentially addressing the memory to read out the stored rhythm pattern, and, when the break circuitry is activated, reading out the break pattern in place of or in addition to the rhythm pattern. The rhythm generator is contained on a single monolithic integrated circuit chip with the pattern selection being accomplished by an external multiplexer driven by an internally generated scan word. The break activation circuitry automatically corrects for improper matching of a rhythmically incompatible rhythm pattern and break pattern by either ignoring the break command or substituting a compatible break pattern in place of the selected break pattern. Channel inhibit circuitry at the input and output of the memory permits selective playing of certain ones of the instrument channels during a rhythm break regardless of whether the break is generated internally of the chip or externally by means of a separate break generator.

17 Claims, 11 Drawing Figures

ELECTRONIC RHYTHM GENERATOR

BACKGROUND OF THE INVENTION

The present invention relates to an automatic rhythm generator and in particular to an electronic rhythm generator adapted for incorporation into an electronic organ as an integral part thereof.

Electronic rhythm generators are well known and generally provide a relatively full complement of percussion sounds, such as brush, cymbal, snare drum, wood block, etc., which are selectively combined in a predetermined sequence and at a rate and spacing which is determined by the particular rhythm selected by the player. For example, a given rhythm sequence may include snare drum, brush, and cymbal percussion sounds which are arranged in a rhythmically pleasing fashion. Generally, the selected rhythm sequence is cycled repetitively every so many measures, which normally comprise sixteen beats each, without the necessity for any intervention by the player.

In order to prevent the rhythm sequence from becoming monotonous, some organs have been provided with break generators, which produce a one or two measure rhythm break sequence which, although rhythmically compatible with the normal rhythm pattern, are sufficiently different to impart a pleasing diversion from the normal rhythm pattern. Because most rhythm patterns are initiated immediately upon depression of the controlling switch or pedal, and terminate when the switch or pedal is released, there is a certain abruptness to the initiation and determination of the rhythm sequence, which causes an unnatural and artificial effect. A rhythm break sequence is advantageous at the beginning and especially at the end of a musical composition to provide a smooth transition into and out of the composition.

Early rhythm units have typically comprised actual rhythm devices, such as drums, cymbals, etc., which were played directly from a keyboard. Obviously, this is unsatisfactory, both from the standpoint of cost and the necessity for the rhythm unit to be played manually by the performer. Later rhythm units were automatic and incorporated electronic sound generators, but the circuitry and mechanical devices for scanning and other control functions were bulky, expensive and unreliable and noisy. With the advent of modern electronics and solid state technology, the circuitry could be greatly simplified and reduced in size and cost, but a large number of components were still necessary thereby creating problems related to complex switching and parts.

MOS technology has enabled the storage capacity and control capability of electronic automatic rhythm generators to be greatly expanded due to the fact that the rhythm patterns can be stored in a read only memory. When using a read only memory for this purpose, however, a great number of external parts are required, such as complex switching, and, due to cost factors, special control circuitry for facilitating operation of the rhythm generator is often not implemented. For example, in one prior art rhythm break generation system, the rhythm break will not operate when a particular rhythmical meter, such as $\frac{3}{4}$ meter, is selected, but the rhythm unit will shut down. This detracts from the automatic character of the rhythm unit and makes it difficult for inexperienced players to use.

Since most present day rhythm units are integrated with the existing organ circuitry, it becomes important for the unit to be adapted for use with a number of organ models, ranging from the single keyboard spinets to the larger consoles without extensive modification. Furthermore, since much of the automatic play features of an electronic organ, such as automatic bass patterns and the like, are controlled and synchronized by the rhythm generator, it may be necessary for some of the rhythm generator channel outputs to remain in operation, during a rhythm break. Selective control of the instrument output channels is, therefore, a desirable feature.

SUMMARY OF THE INVENTION

The rhythm generator according to the present invention combines the necessary elements to provide a large capacity, flexible rhythm unit capable of being integrated with present day electronic organs having a wide variety of easy play features. In order to take maximum advantage of MOS technology, virtually the entire rhythm generator is integrated on a single monolithic integrated circuit chip. Although this creates its own set of problems in terms of restricting the inputs and outputs for the chip to forty pins or less, as dictated by present day integrated circuit convention, a variety of techniques have been utilized to make extremely efficient use of the chip pins.

One such technique is the manner in which the rhythm patterns and rhythm break patterns are selected by the player. A plurality of external selector switches for the various rhythm patterns, such as waltz, foxtrot, rock, etc., and the bass pattern/alternating pedal selection are multiplexed by means of an external multiplexer arrangement. The multiplexers are driven by a four bit scan word derived internally of the chip to produce a time division multiplexed data stream brought into the chip on a single pin. Thus, sixteen different rhythm selections can be realized through the use of only five integrated circuit chip pins. This system also permits a great deal of flexibility in that the number of selections can be doubled merely by adding an extra output pin to drive a larger capacity multiplexer. Obviously, the same multiplexing arrangement could be utilized to bring into the chip a variety of other control signals, if this were necessary.

The rhythm patterns, rhythm break patterns, drum roll and woodblock patterns are contained in a single read only memory internally of the chip and appropriate selection of the rhythm patterns are accomplished by demultiplexing division multiplexed data stream brought in on the single receive pin. The read only memory is scanned by an internal clock driven six bit counter, which scans all of the stored patterns simultaneously by means of sixty-four address lines, and outputs for the various rhythm instrument channels are combined onto twelve output channels, which are brought out of the chip over twelve output pins. The chip has its own inhibiting system that allows the chip to be used in parallel with an external break generator, in which case all or a portion of the rhythm channels may be inhibited. The chip has its own strobe generating system, sync generating system, and an internal psuedo random noise generator, which provides white noise for the external rhythm voicing circuits. Special drum roll and woodblock enable channels parallel the snare drum channel and woodblock channels, respectively, in each pattern. The drum roll and woodblock channels may be enabled simultaneously with the playing of either the rhythm sequence or rhythm break sequence by a player operated switch connected to a decoder contained within the chip.

The rhythm break system is closely tied with the normal rhythm system and may be played simultaneously with a normal rhythm pattern by selectively disabling certain of the normal pattern inputs to the read only memory. The break is selected by depressing a momentary switch, which results in setting the break latch, resetting the internal rhythm counter to count one, and then playing the break pattern either in place of or in addition to the normal rhythm pattern.

A type of "human engineering" is provided whereby rhythmical meter compatability is ensured between the selected rhythm pattern and selected rhythm break pattern. Since the rhythm and break patterns may be 4/4, $\frac{3}{4}$ or 5/4 time, the player may accidentally or through ignorance select rhythm and break patterns which are incompatible, as, for example, a $\frac{3}{4}$ rhythm pattern and a 4/4 rhythm break pattern. Not only would this sound unpleasing, but, due to the fact that the rhythm counter has its count length modified from thirty-two counts to twenty-four counts for $\frac{3}{4}$ time, the 4/4 rhythm break could not be completely played before the system is reset for the resumption of the normal rhythm pattern. In order to prevent this situation, the present invention provides means for overriding the break pattern selection so that it is compatible with the rhythm pattern selection. In the example just given, a $\frac{3}{4}$ break pattern would be automatically selected by the system regardless of the pattern selected by the player. Alternatively, the chip can be programmed to ignore an improper break pattern selection command so that no break would be played at all, but the rhythm unit would continue to operate to provide the normal rhythm pattern.

DETAILED DESCRIPTION

Figure 1:
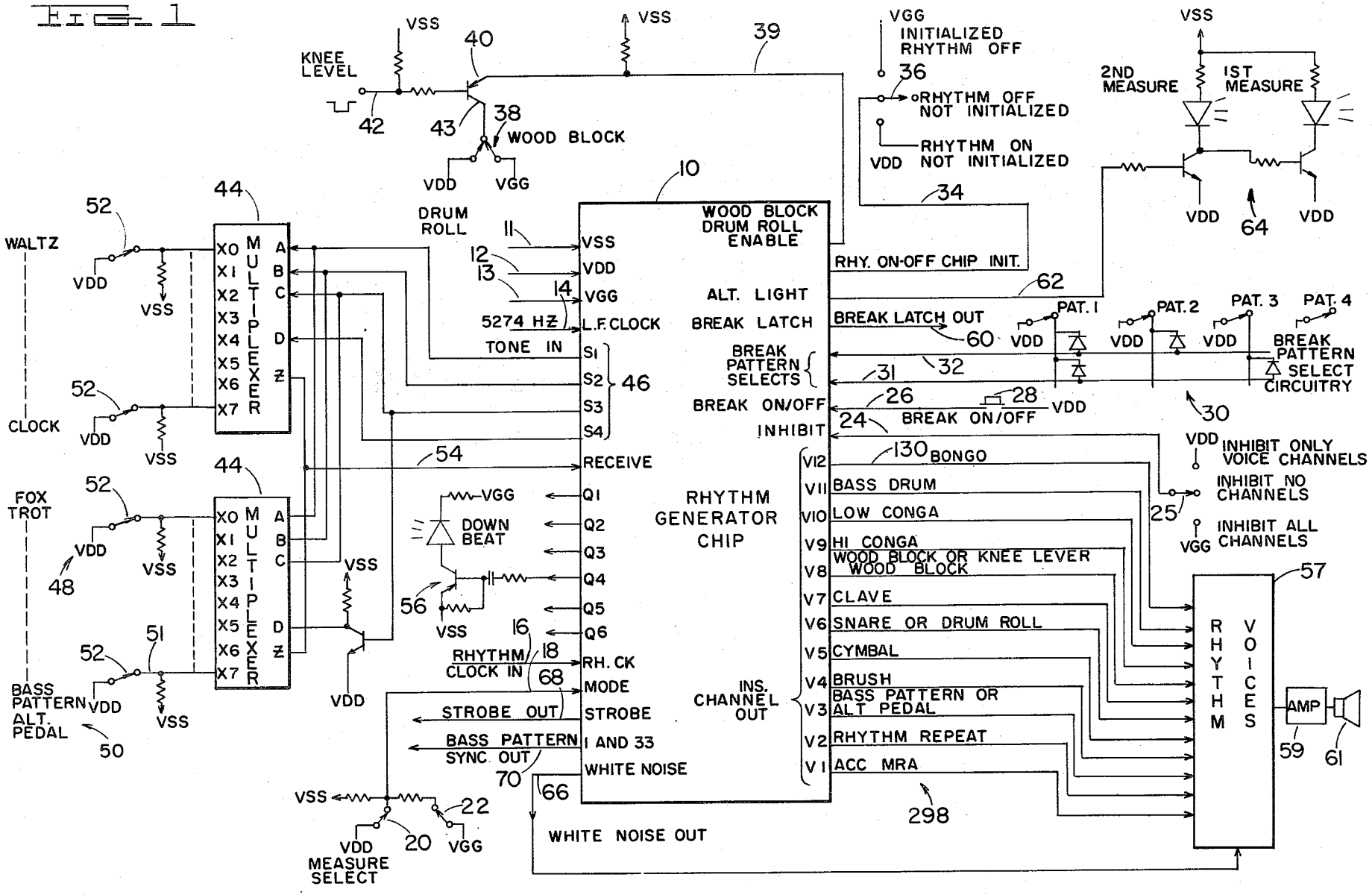
FIG. 1 is a schematic diagram of the rhythm generator integrated circuit chip and the associated external control and indicating circuitry.

Referring now to the drawings in detail, and in particular to FIG. 1, the rhythm generator according to the present invention is shown as a single monolithic integrated circuit chip 10 having forty input/output pins. The power supply for the system is brought in on three pins connected to lines 11, 12 and 13, the 5274 Hertz low frequency clock tone is brought in on line 14, and the rhythm clock is brought in on line 16. The mode control pin connected to line 18 determines whether the rhythm unit will play in the first two measures, the last two measures, or alternate between the first two measures and last two measures. This is accomplished by closing switch 20 or switch 22 or neither.

Line 24 is connected to switch 25, which is selectively positioned to inhibit none of the voice channels, all of the voice channels or only certain voice channels. Some or all of the voice channels would be inhibited when an external break generator 306 (FIG. 8) or rhythm generator is utilized, and where it is necessary for the rhythm system to continue operating to drive other systems in the organ. Line 26 is connected to a momentary push-button switch 28 and provides the break on/off signal. The break patterns are selected by means of diode matrix 30 which provides a two bit binary select word on lines 31 and 32. The rhythm on/off and initialize control signal is brought in on line 34 from switch 36. Switch 38 activates either the drum roll or wood block channel and is brought into chip 10 on line 39. Transistor 40 is turned on by a signal on line 42 when the organ knee lever (not shown) is closed and its collector 43 is switched from either the drum roll signal at VDD or the wood block signal at VGG potential. With the transistor 40 turned on and VDD applied, the drum roll is activated, and with the transistor on and VGG applied, the wood block is enabled. With the transistor turned off, neither is activated.

A pair of MC 14512 CMOS multiplexers 44 are driven by the S1 through S4 scan outputs 46 and multiplex the fifteen rhythm pattern inputs 48 and the single bass pattern/alternating pedal input 50. When one of the switches 52 for inputs 48 and 51 is closed, a pattern select signal will appear in a corresponding time slot in the serial data stream on line 54, which is the rhythm pattern receive line for chip 10. The bass pattern and alternating pedal pattern channels are activated upon closing and opening, respectively, switch 52 connected to input 51.

The Q1, Q2, Q3, Q4, Q5 and Q6 outputs are the outputs from the internal six bit rhythm counter 92 (FIG. 2D) and may be utilized to provide timing and synchronization for other organ systems. The Q4 output is connected to lamp circuit 56, which flashes at the end of each measure. Instrument channels V1 through V12 correspond to the accompaniment musical rhythm accompaniment, accompaniment rhythm repeat (MRA musical rhythm accompaniment), bass pattern/alternating pedal, brush, cymbal, snare or drum roll, clave, wood block/knee lever wood block, high conga, low conga, bass drum and bongo outputs, respectively, and are fed to rhythm voicing circuit 57, amp 59 and speaker 61. The break latch output signal is brought out on line 60, and line 62 carries the alternating output signal which drives a dual transistor circuit 64 indicating which of the two measures of the rhythm unit are activated. White noise is brought out on line 66 and is generally used for certain types of voicing, such as cymbals, for example. The strobe output signal is brought out on line 68, and the bass pattern sync at the beginning of each two measure pattern is brought out on line 70.

Figure 2A:
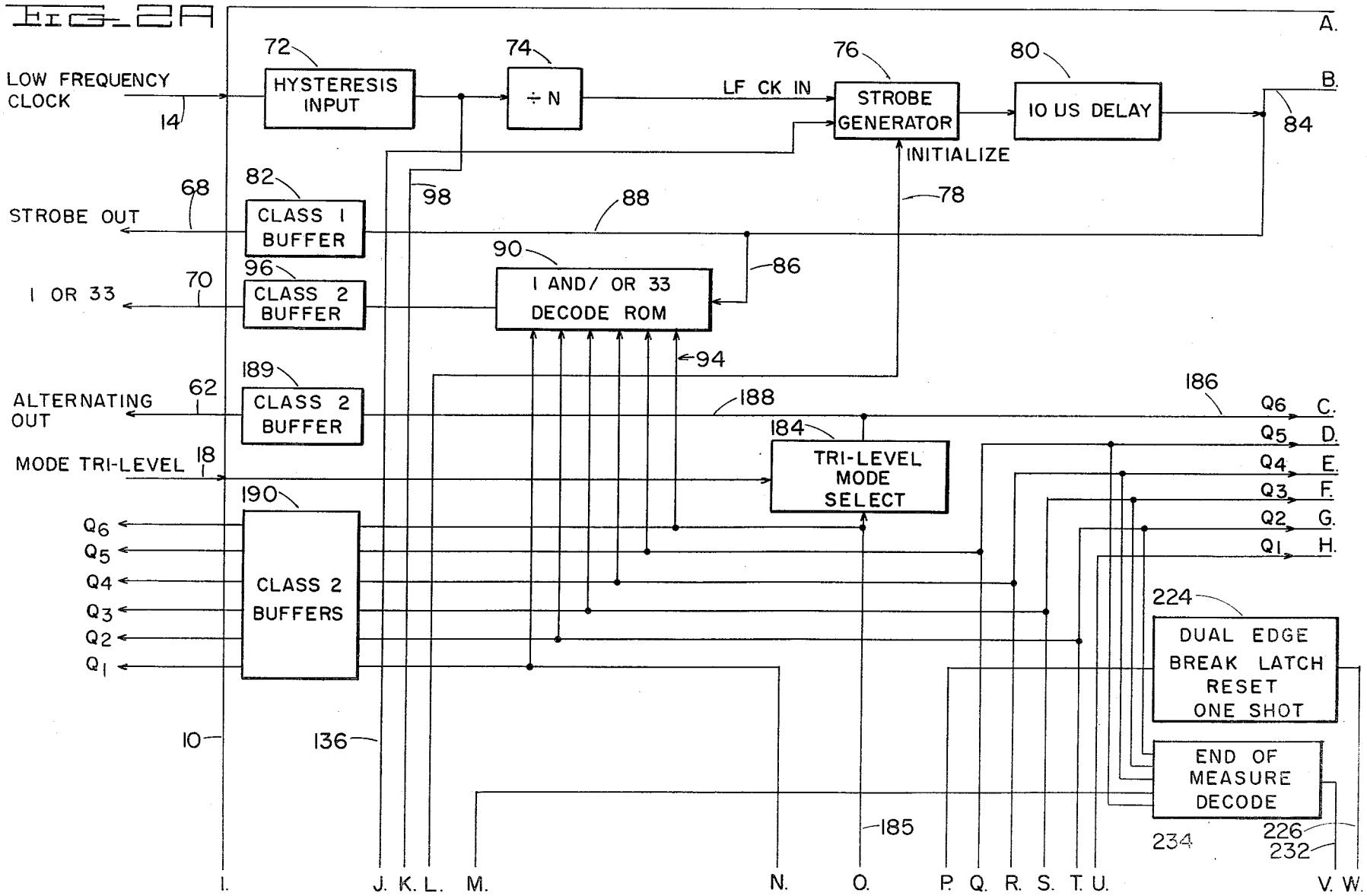
FIGS. 2A, 2B, 2C and 2D together comprise a detailed block diagram for the internal circuitry of the integrated circuit chip of FIG. 1.

Referring now to FIG. 2A, the low frequency clock input on line 14 comes into an hysteresis input 72, which permits the low frequency clock signal to have slow rise and fall times yet still cause proper operation of the system. The low frequency clock then passes through a divide by N circuit 74, which divides the frequency down to a value which is usable for generating strobe pulses in strobe generator 76. Strobe generator 76, which is initialized by a signal on line 78 from input pin 34, (FIG. 2D), may comprise logic gating and an N-bit counter, for example. Normally, the strobe output is a logic 1 pulsing to a logic 0 for two to five milliseconds, depending upon the frequency of the low frequency clock signal on line 14. This output is then delayed for ten microseconds by delay 80 and fed to the strobe output line 68 through a class 1 buffer 82. The external strobe pulse is utilized for external strobing purposes. The strobe output on line 84 is also utilized to strobe the instrument channel outputs, as will be described later. Line 86 is connected to the output of delay 80 through line 88 and feeds into the input of 1 or 33 decode ROM 90. ROM 90 decodes the Q1 through Q6 outputs of the six bit rhythm counter 92 (FIG. 2D) on lines 94 and provides a synchronizing strobed pulse on line 70 at the output of buffer 96 on counts 1 and 33 of counter 92. These counts correspond to the first beats of the respective two measure rhythm patterns. ROM 90 may be programmable to provide the synchronizing pulse on other states of rhythm counter 92, if desired.

The low frequency clock train on line 98 at the output of hysteresis input 72 is connected to the input of a two phase clock generator 100, (FIG. 2D) which generates a pair of out-of-phase clock signals on lines 101 and 102, respectively. Phase one of the clock 100 drives a four bit binary internal counter 104, which has outputs 106 identified as S1, S2, S3 and S4. The initializing pulse for counter 104 is brought in on line 108. Counter outputs S1 through S4 form a four bit scan word which is buffered by class three buffers 110 and then brought out on lines 46.

The S1–S4 scan word drives external multiplexers 44 which have their inputs connected to the rhythm pattern selection and bass pattern/alternating pedal switches 52. The time division multiplexed pattern select data from multiplexers 44 is brought into chip 10 over line 54 through hysteresis input 112. The serial data stream is then presented to one-to-sixteen demultiplexer 114, which is driven by the S1–S4 scan word from counter 104, to produce the parallel format pattern select input on lines 116. The pattern select input is latched by latches 118, which are initialized by the initialize control signal on line 120 and clocked by the respective clocking signals on lines 122 from one to sixteen clocking circuit 124. Circuit 124 is clocked by the phase two output of clock generator 100 and provides the clocking output on respective lines 122 for each step of counter 104 during its full sixteen state cycle as indicated by the S1-S4 scan word on lines 126.

The outputs 128 of pattern enable latches 118 carry the information representing the rhythm patterns which are selected, for example: waltz, rock, foxtrot, etc., and the bass pattern/alternating pedal output command from the appropriate switch 52. It can be seen that the low frequency clock input on line 14 serves a dual purpose: firstly, to provide strobe pulses for internal and external synchronization, and, secondly, to provide a clock for multiplexing in the rhythm pattern select information on receive line 54.

The technique of utilizing internally generated scan words for external multiplexers to bring in the rhythm select information is extremely advantageous in that it permits economy of the chip external pins. Since, by custom in the trade, most chips have a maximum of forty external pins, it becomes extremely important to convey as much information as possible either into or out of the chip over each pin.

The rhythm clock pulse train is brought into chip 10 over line 16 from an external rhythm clock (not shown), which is normally controllable by the player to operate over a range of speeds, depending on the tempo desired. Line 16 is connected to the input of hysteresis input 134 and from there to the input of strobe generator 76 (FIG. 2A) over line 136. In this manner, the rhythm clock pulses are strobed by the divided down low frequency clock input on line 14.

Figure 5:
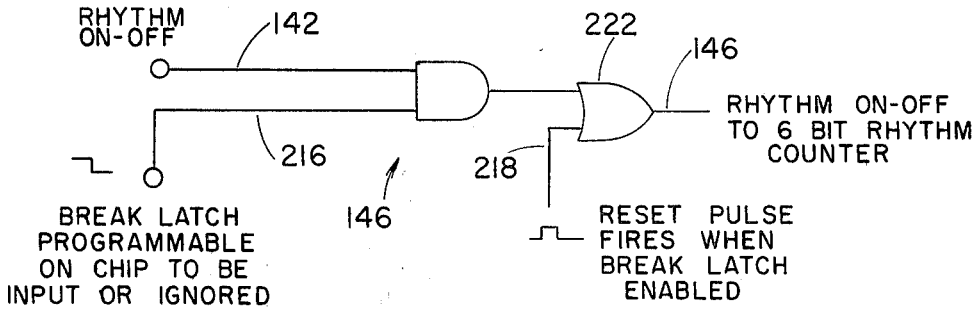
FIG. 5 is a detailed schematic of the on/off gating block in FIG. 2D.

The rhythm clock output from hysteresis input 134 is fed to the clocking input 138 of six bit rhythm counter 92. Counter 92 provides sixty-four distinct output states on its six output lines 140 which are identified as Q1, Q2, Q3, Q4, Q5 and Q6. This is sufficient for four measures of rhythm, each comprising sixteen beats. Rhythm counter 92 is turned on and off by a signal on line 142 from the rhythm on/off tri-level decoder circuit 144, which is connected to external switch 36 over line 34. This control signal is fed through on/off gating 146 and fed to the on/off input for counter 92 over line 148. When tri-level decoder 144 receives a VGG input, counter 92 will be turned off and the various portions of the circuit will be initialized, which resets them into a known state for testing purposes. With zero volt input to decoder 144, the rhythm unit will be turned off, and when VDD is received, the rhythm unit will be turned on. On-off gating 146 is shown in FIG. 5, and will be described at a later point.

Figure 2B:
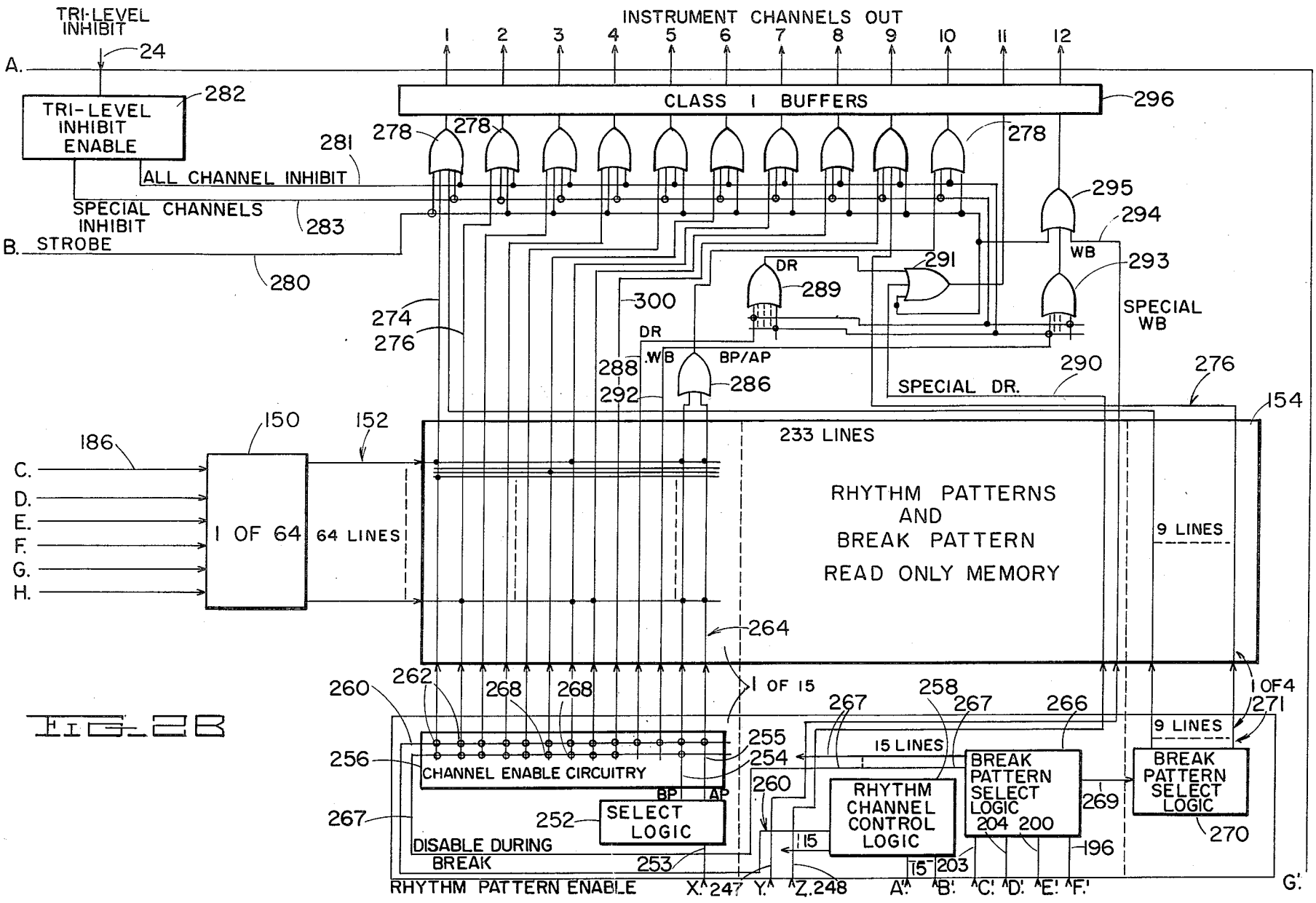
Figure 3:
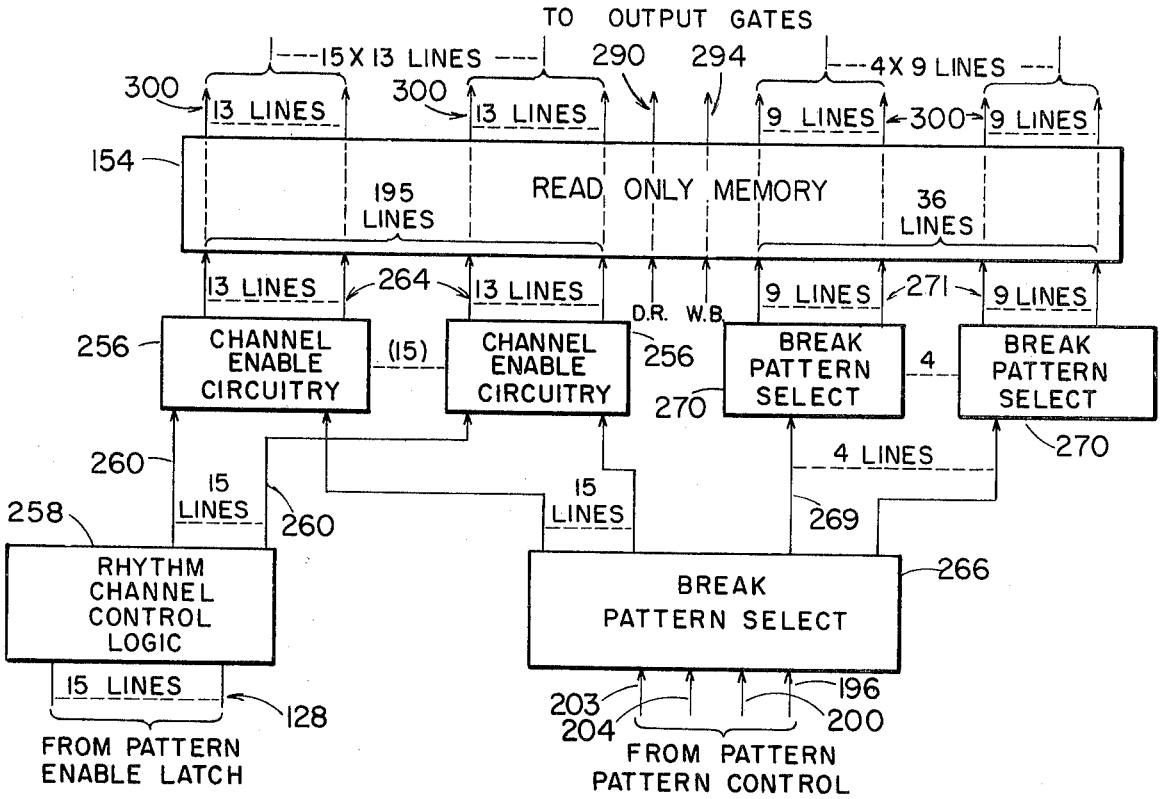
FIG. 3 is a more detailed schematic diagram of the read only memory containing the rhythm and break patterns, and the input control circuitry thereof.
Figure 4:
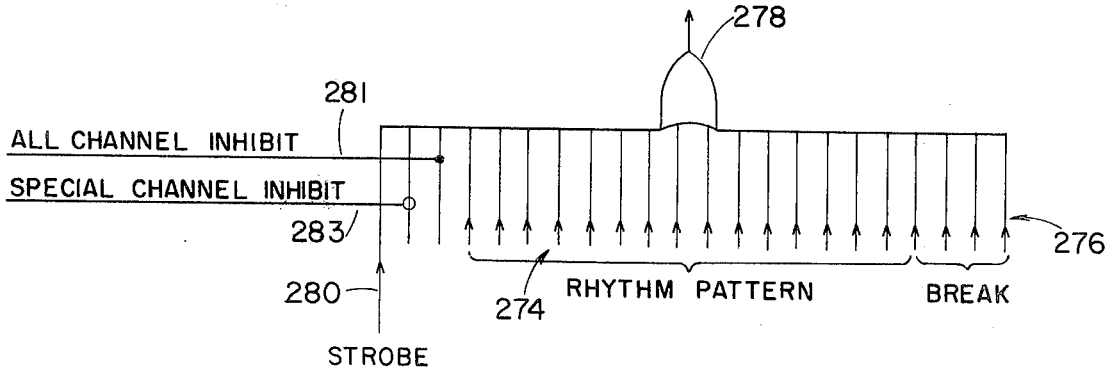
FIG. 4 is a schematic diagram of one of the instrument channel output OR gates and its inputs.

Returning now to rhythm counter 92, its six outputs Q1–Q6 drive one of sixty-four decoder 150 (FIG. 2B), which sequentially activates each of its sixty-four outputs 152. Each of the sixty-four lines 152 from decoder 150 extends completely through the large rhythm pattern and break pattern read only memory 154. ROM 154 has sixty-four lines 152 extending horizontally and two hundred and thirty-three lines extending vertically as viewed in FIG. 2B. ROM 154 comprises a sixty-four by fifteen by thirteen portion for the fifteen rhythm patterns each comprising nine instrument channels (bass drum, low conga, high conga, wood block, clave, drum roll, cymbal, bongo and brush, bass pattern, alternating pedal, rhythm repeat, and musical rhythm accompaniment. ROM 154 also includes a sixty-four by four by nine section for four break patterns connecting to the nine first-mentioned instrument channels, a sixty-four by one by one section for the wood block, and a sixty-four by one by one section for the drum roll (FIG. 3). As lines 152 are sequentially activated, those selected vertical lines which are electronically connected to them will also be activated at the respective times in the count sequence. Since read only memories such as ROM 154 are well known in the art, no further description of it will be necessary, except to say that ROM 154 is custom programmed to provide the various rhythm patterns by electronically tying the horizontal lines 152 to selected ones of the vertical lines.

Figure 2C:
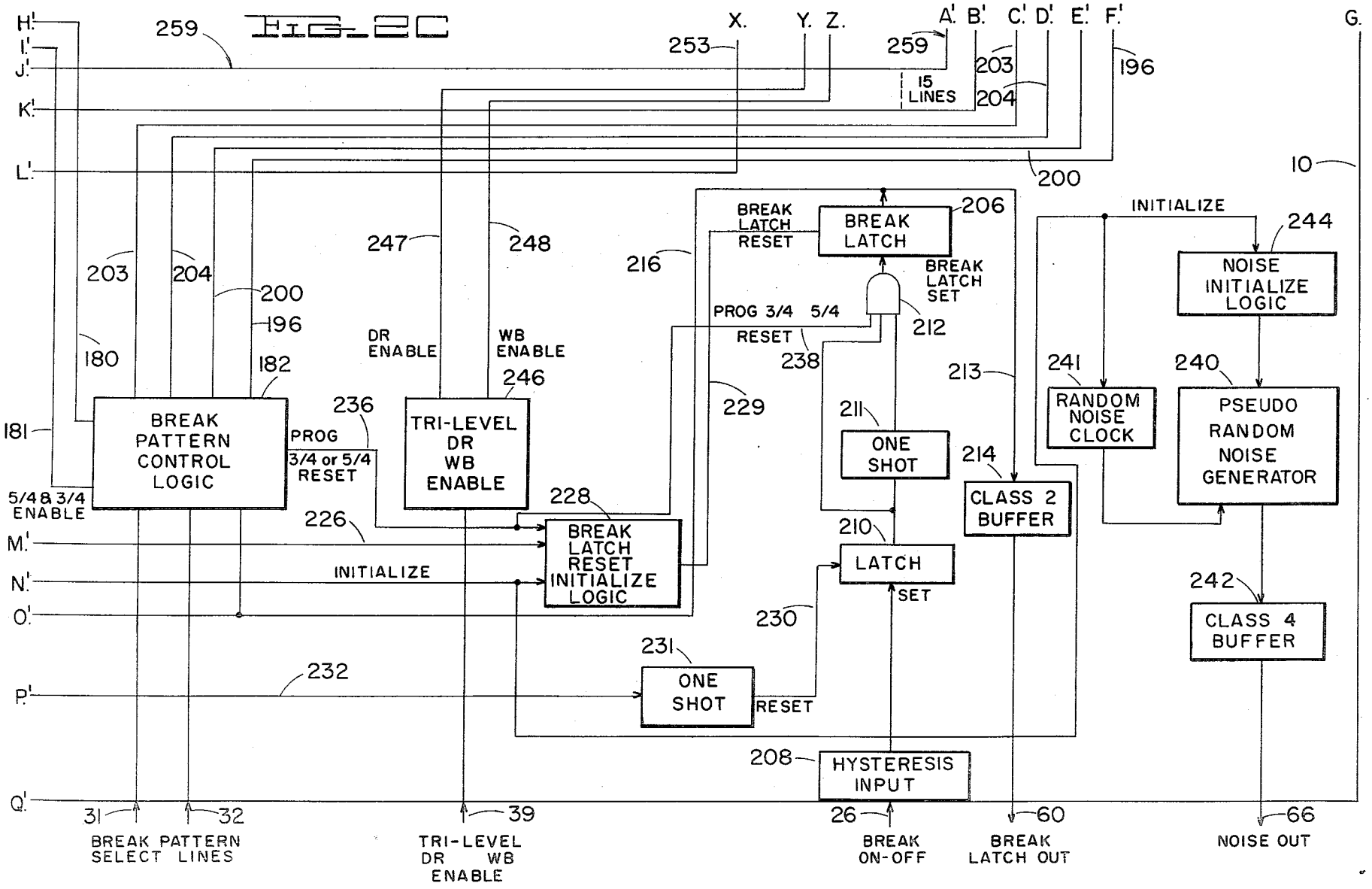
Figure 2D:
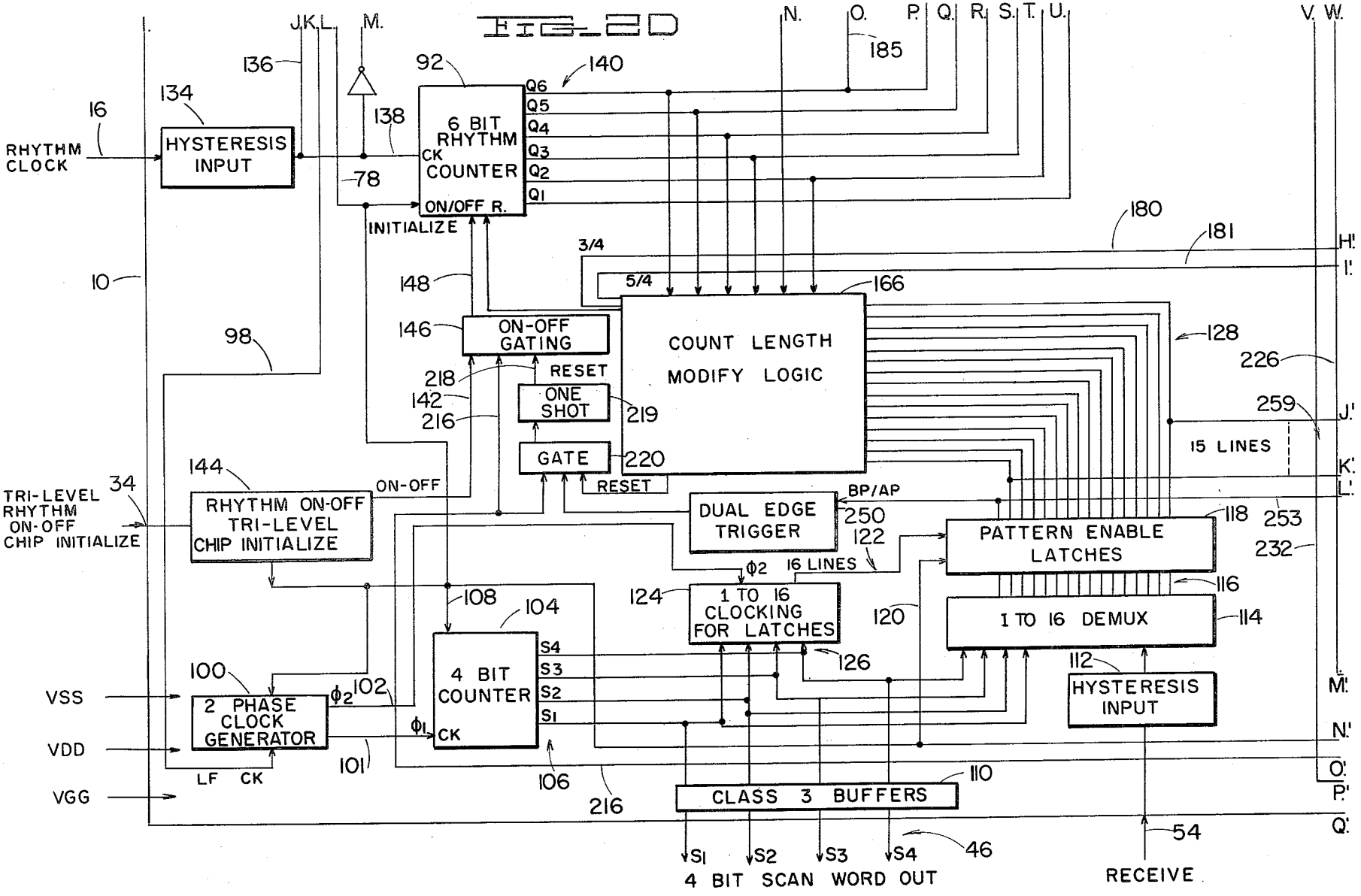
Figure 7:
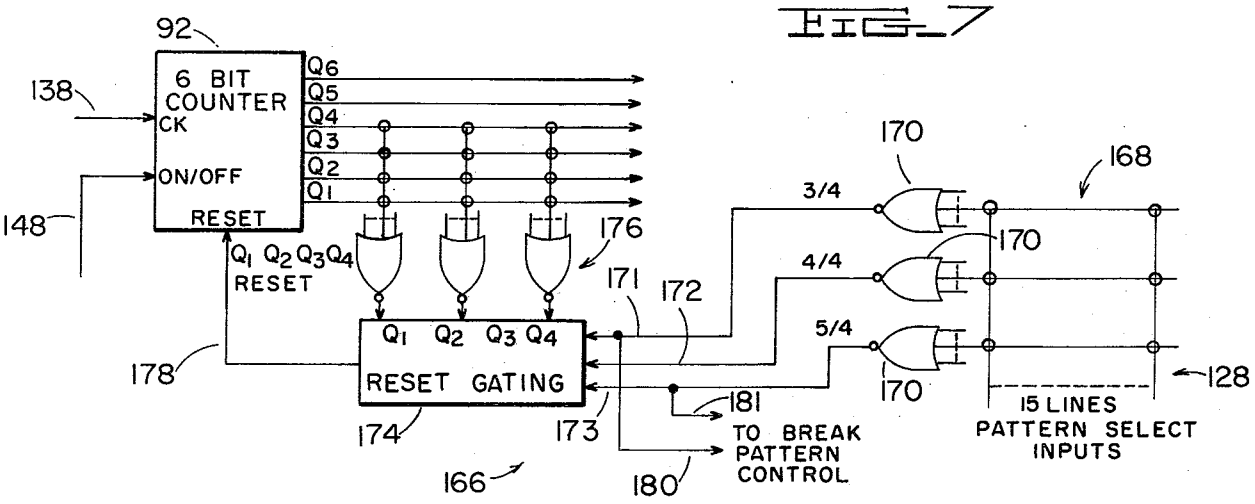
FIG. 7 is a detailed schematic of the count length modify logic block of FIG. 2D.

With reference now to FIGS. 2D and 7, the Q1–Q6 outputs of counter 92 are fed to the inputs of count length modify logic circuit 166, which may take the form shown in FIG. 7. Because all rhythms are not in 4/4 time, it is necessary to modify the count sequence produced by counter 92 for $\frac{3}{4}$ and 5/4 time. For example, a 6/8 march and a waltz are all in $\frac{3}{4}$ time, whereas a foxtrot is in 4/4 time. The pattern select inputs 128 are decoded by matrix 168 and NOR ROMs 170 to cause one of lines 171, 172 or 173 to be activated. Reset gating circuit 174 and NOR ROMs 176 decode the Q1, Q2, Q3 and Q4 outputs from counter 92 to cause a reset signal on line 178 to reset six bit counter 92 at the appropriate count.

In other words, this arrangement decodes a portion of the count, determines which rhythm timing (4/4, $\frac{3}{4}$, 5/4) is selected, and then resets the first four bits of the counter at various times during the count sequence. In $\frac{3}{4}$ time, for example, counter 92 counts from 0 through 11, count 12 is decoded and gating 174 resets the first four bits of counter 92 so that it in effect skips to count 16 and so on. A similar sequence of events takes place in the case of 5/4 time except that different counts are deleted. In 4/4 time, counter 44 counts through the entire sixty-four step sequence.

Figure 6:
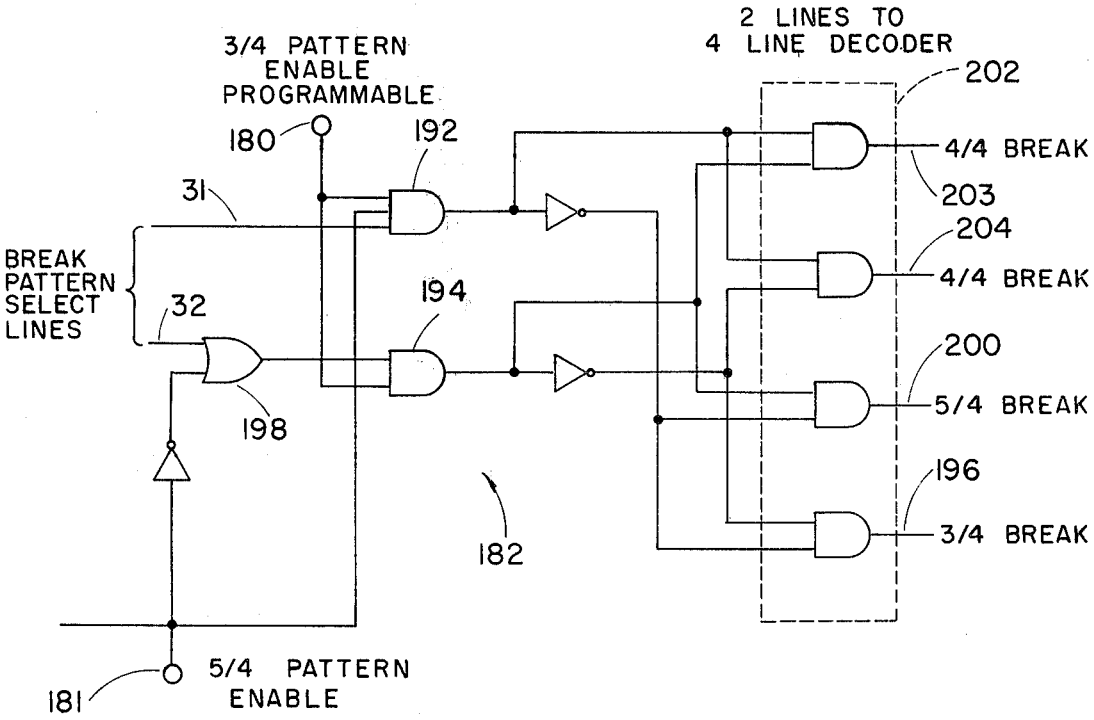
FIG. 6 is a detailed schematic of the break pattern control logic block of FIG. 2C.

The connections between lines 128 and 168 and between the inputs to NOR ROMs 176 and the Q1–Q4 counter outputs are programmable, and may be altered when the chip is produced so that the appropriate decoding may be accomplished. The gating circuitry for reset gating 174 may be relatively straightforward so that matching logic levels from the outputs of NOR ROMs 176 and 170, each of which decodes its inputs, will cause a reset pulse to appear on line 178. Lines 180 and 181 from the $\frac{3}{4}$ and 5/4 NOR ROMs 170, respectively, are connected to break pattern control circuit 182 (FIGS. 2C and 6).

The most significant bit output Q6 of counter 92 is presented to one of the inputs of tri-level mode select circuit 184 (FIG. 2A) over line 185. Select circuit 184 has a second input connected to line 18, which is the mode input line from measure select switch 20. Circuit 184 has three activation levels: one allowing the Q6 bit output to be presented to one of sixty-four decoder 150 over line 186, the second level locking the Q6 output to a logic 0 and the third level locking the output to a logic 1. This allows ROM 154 to be scanned by alternate halves: the first being by the first thirty-two lines driven by the Q1 through Q5 outputs of counter 92 with the Q6 output at logic 0, and the second by lines 33–64 driven by the Q1 through Q5 outputs of counter 92 with the Q6 output at logic 1. This provides additional flexibility by permitting the player to repeat the first two or last two measures of the pattern without repeating the other, so that there are, effectively, thirty patterns from which the player can select. Obviously, however, by permitting the Q6 output of counter 92 to alternate between a logic 0 and logic 1 states, the full four measures of the pattern will be played. An output from mode selector 184 is provided over line 188 through buffer 189 to the alternating output line 62, which can be utilized for synchronizing purposes and to activate a downbeat lamp circuit 56 to provide the performer and the remainder of the external organ systems with the information as to which half of the large pattern ROM 154 is being activated. All six of the outputs from counter 92 are brought out of chip 10 through buffers 190 for external synchronizing purposes.

The break generation circuitry, which enables the performer to play a two measure break pattern in place of the normal rhythm pattern, will now be described (FIGS. 2B and 2C). The break pattern select lines 31 and 32 from break pattern select circuitry 30 carry a two bit binary word representative of one of four possible pattern selections. This is connected to two inputs of break pattern control logic circuit 182 (FIGS. 2C and 6), which functions as a two line to four line converter with overrides. Logic 182 is also sensitive to whether the rhythm unit is in $\frac{3}{4}$ or 5/4 tempo, because if there are no $\frac{3}{4}$ or 5/4 tempo patterns programmed in the break, or if these breaks are not selected, then logic circuit 182 will not permit the system to go into the break mode, or will override and force the break selection into a compatable break.

In this circuit, the $\frac{3}{4}$ patterns dominate the 5/4 patterns, which dominate the 4/4 patterns. When the $\frac{3}{4}$ input 180 from count length modify logic 166 is forced to a logic 0, the outputs of AND gates 192 and 194 (FIG. 6) are forced to a logic 0, and the $\frac{3}{4}$ break line 196 is enabled. If the unit is in a 5/4 pattern so that line 181 is at logic 0, AND gate 192 will be at a logic 0 and AND gate 194 will be at logic 1 via OR gate 198. This logic combination will select the 5/4 break line 200. If neither line 180 or 181 is activated, then the two line to four line decoder 202 will function normally to select one of lines 203, 204, 200 or 196 depending on the two bit binary word on inputs 31 and 32. This feature protects the user from selecting a break pattern that is not in the proper tempo. If there are no $\frac{3}{4}$ or 5/4 break patterns programmed, the $\frac{3}{4}$ and 5/4 enable lines can be utilized as a reset, which resets the break latch 206 and allows no breaks during those two tempos.

The break on/off control signal is brought into chip 10 on line 26 and passes through hysteresis input 208 after which it sets a temporary latch 210. The setting of latch 210 fires one shot 211, which ensures the break latch of being set into the break mode and eliminates any bouncing of the break on/off input. The output from one shot 211 is gated by AND gate 212 to set break latch 206, the output of which is brought out of chip 10 over line 213, buffer 214 and line 60. Line 60 may be connected to a lamp circuit which will light thereby indicating that the break latch is set.

The output of break latch 206 is also connected to on-off gating circuit 146 over line 216. Gating 146 (FIGS. 5 and 20) is programmable so that if the rhythm on/off signal on line 142 is turned off during a break, the break will or will not continue to play until the full break passage is completed depending on the programming. Normally, the break will be completed after thirty-two counts of the sixty-four count rhythm counter 92. When the break is activated, counter 92 is reset to its initial state.

Gating circuit 146 is shown in detail in FIG. 5. There are three inputs to gating circuit 146: rhythm on/off line 142, line 216 from break latch 206, and a reset pulse on line 218 from one shot 219 in gate 220, the latter also being derived from break latch 206. Whenever rhythm on/off line 142 goes to logic 0 (VDD) and there is no reset pulse, the output of OR gate 222 is forced to logic 0 and the rhythm unit is turned on. When the break latch 206 is enabled, it also forces the output of gate 222 to logic 0 and turns on the rhythm unit. When break latch 206 is enabled and the reset pulse from line 218 is placed on one of the inputs of OR gate 222, the rhythm unit is turned off and then immediately back on again thereby resetting the rhythm counter and permitting the rhythm unit to continue to play during the break.

Break latch 206 is programmable on chip 10 so that it can be ignored as a rhythm on/off command. With break latch 206 programmed in, the rhythm unit can be turned on for a break and then turn off automatically as soon as the break latch 206 resets.

The rhythm break will play for two sixteen count measures, depending on which half of the rhythm break section of ROM 154 is enabled by the mode signal on line 186 (FIG. 2A). Break latch 206 is reset when the Q6 output of rhythm counter 92 goes through transition and activates one shot 224 (FIG. 2A), which places a pulse on line 226. This is latched in break latch reset logic 228, which provides a reset signal on line 229 for resetting break latch 206. Before break latch 206 is reset, however, temporary latch 210 is reset by a pulse on line 230 from one shot 231, which is triggered by a pulse on line 232 from end-of-measure decode circuit 234 (FIG. 2A). Decode circuit 234 decodes the Q1 through Q4 outputs of counter 92 and resets latch 210 just before latch 206 is reset. Since the purpose of temporary latch 210 is to ensure that break latch 206 is set, by resetting latch 210 before latch 206, single measure operation is ensured. Break latch 206 can also be reset by break pattern control logic 182 which has a programmable output 236 capable of resetting latch 206 through logic 228. A reset signal on line 238 will disable AND gate 212 from setting latch 206.

Random noise generator 240, which is clocked by random noise clock 241 provides white noise on output pin 66 through buffer 242. Generator 240, which is typically a seventeen stage polynominal counter, is initialized for testing purposes from noise initialize logic 244.

The rhythm unit is provided with a special wood block and drum roll feature which is enabled by a control signal on input pin 39 to tri-level decoder 246 to provide parallel channels of drum roll enable and wood block enable on lines 247 and 248. Lines 247 and 248 are connected directly to ROM 154 and parallel the other rhythm and break pattern lines. Tri-level enable decoder 246 enables neither the drum roll nor wood block at one logic level, enables the drum roll only at a second logic level, and enables the wood block only at a third logic level. Thus, two different control functions can be brought in on a single pin.

Referring now in detail to FIGS. 2B, 2D, 3 and 4, the inputs and outputs for pattern ROM 154 will be described. The bass pattern/alternating pedal output from pattern enable latches 118 is connected to the input of a dual edge trigger 250, which resets counter 92 when a bass pattern or alternating pedal is selected and is programmed to do so. The bass pattern/alternating pedal signal is also fed to the input of tri-level decoder select logic 252 (FIG. 2B) over line 253. Select logic 252 activates either the bass pattern line 254 or the alternating pedal line 255, which are connected to two of the inputs of channel enable circuitry 256. The fifteen rhythm pattern outputs from pattern enable latches 118 are connected to the inputs of rhythm channel control logic 258 over lines 259. Rhythm channel control logic 258 routs the inputs for the rhythm patterns on lines 259 to respective channel enable circuits 256 over lines 260, with one line 260 being connected to each of the channel enable circuits 256. By virtue of programmable connection points such as 262, an appropriate signal on line 260 from control logic 258 will enable the thirteen vertical instrument channel lines 264 for ROM 154. Since it may be desirable to disable certain of the instrument channels during particular breaks, break pattern select logic 266 may provide a disabling signal on line 267, which is connected to certain ones of the instrument channel lines 264 by programmable connection points 268.

Break pattern select logic 266 is connected to break pattern control logic (FIGS. 2C and 6) over lines 203, 204, 200 and 196 and has four output lines 269 connected to four respective break pattern select logic circuits 270. Each break pattern select logic circuit 270 has nine output lines 271, which feed through ROM 154 and are selectively connected to certain ones of the horizontal sequentially actuated lines 152 at the outputs of one of sixty-four decoder 150. Depending on which of lines 203, 204, 200 and 196 is activated, one of the break pattern select logic circuits 270 will enable its nine output lines 271. As mentioned earlier, the disabling signal on line 267 is for the purpose of disabling certain of the normal instrument channels during particular breaks. All of this is capable of being mass programmed when the chip is manufactured. Normally, the break pattern select logic 266 will disable nine of the twelve instrument channels, and the other three instrument channels are programmable to either ignore the break or continue during the break depending on which rhythm pattern is enabled.

Looking now at the outputs of ROM 154, each of the instrument channel inputs for the fifteen rhythm patterns and the four break patterns on lines 274 and 276, respectively, (FIG. 4) are collected through multiple input OR gates 278. Also connected to the inputs of OR gates 278 is a strobe input 280 connected to line 84 at the output of delay circuit 80, an all-channel inhibit line 281 from tri-level inhibit enable 282, and a special channel inhibit line 283 also connected to inhibit enable 282. Inhibit enable 282 receives its input signal on line 24 from switch 25, with logic 0 being the normal condition letting all outputs from ROM 154 feed out as programmed, logic 1 inhibiting only certain of the voices, and a third logic level inhibiting all of the outputs. This is utilized for external break generating systems (not shown) or rhythm instrument shutdown without shutting down the entire rhythm system so that other systems may continue to be driven. It will be seen from FIG. 2B that line 281 is connected to the inputs of every OR gate 278 so that they will all be disabled when the disabling signal appears on line 281. Line 283, on the other hand, is mask programmed for connection to only certain of the OR gates 278 so that certain instrument channels will be permitted to feed out. The strobe pulse on line 280 is delayed by ten microseconds to ensure that when the break latch is reset at the beginning of a new measure, the strobe for the first count of the next measure does not occur while the ROM addresses are changing.

The bass pattern and alternating pedal lines from ROM 154 are combined by OR gate 286 and are connected as the voice channel input to the appropriate OR gate 278. The drum roll signal on line 288 is enabled or disabled at OR gate 289 and then combined with the special drum roll signal on line 290 by OR gate 291. Similarly, the wood block signal on line 292 is enabled or disabled at OR gate 293 and then combined with the special wood block signal on line 294 by OR gate 295. OR gates 291 and 295 are strobed by the strobe signal on line 280.

The ouputs of OR gates 278, 291 and 295 pass through class 1 buffers 296 and are fed out of chip 10 on pins 130 and 298.

To summarize the operation of ROM 154 and its associated circuitry, depending on the activated line 259 from pattern enable latches 118, rhythm channel control logic 258 will enable one of the channel enable circuits 256 pertaining to a particular rhythm pattern. As discussed previously, this is accomplished by demultiplexing the serial data stream on line 54, which originated from chip driven multiplexers 44. A break pattern may also be selected by matrix 30 and brought in as a two bit binary word on lines 31 and 32 to break pattern control logic 182. This circuit will select one of lines 203, 204, 200 or 196 which causes break pattern select logic 266 to enable one of the break pattern select logic circuits 270 and if programmed, disable all or some of the instrument channels for each of the rhythm pattern channel enable circuits 256, when the break latch 206 is set.

Assuming that break on/off button 28 (FIG. 1) has not been depressed, as counter 92 counts from one to sixty-four, lines 152 will be sequentially enabled and, depending on the program connections between them and the output lines 254 from the activated channel enable circuit 256, selected OR gates 278 will be activated for each rhythm count by the appropriate signals on lines 274, 276, 292 and 288 from ROM 154. When break on/off button 228 is depressed, break latch 206 will be set, counter 92 will be reset, and the appropriate break pattern select logic circuit 270 will be activated to enable its output lines 271. Then, as counter 92 counts from one to thirty-two or from thirty-three to sixty-four, the instrument channels activated by the programmably connected break pattern lines 271 will be activated for the two measure break. During the break, the previously activated channel enable circuitry may be disabled either completely or partially, depending on the programming for the chip.

The special wood block and drum roll lines 294 and 290 are activated by closing the appropriate switch 38 and then actuating the knee lever (not shown) or other momentary contact device so as to place the appropriate control signal on line 39.

The OR gates 278 for instrument channels 1 through 9 each have twenty-two inputs: fifteen for the rhythm patterns, four for the break patterns, two for the inhibits, and one for the strobe pulse. OR gate 278 for instrument channel 10, OR gate 291 for channel 11 and OR gate 295 for channel 12 each have eighteen inputs: fifteen for the rhythm patterns, two for the inhibit, and one for the strobe pulse.

Figure 8:
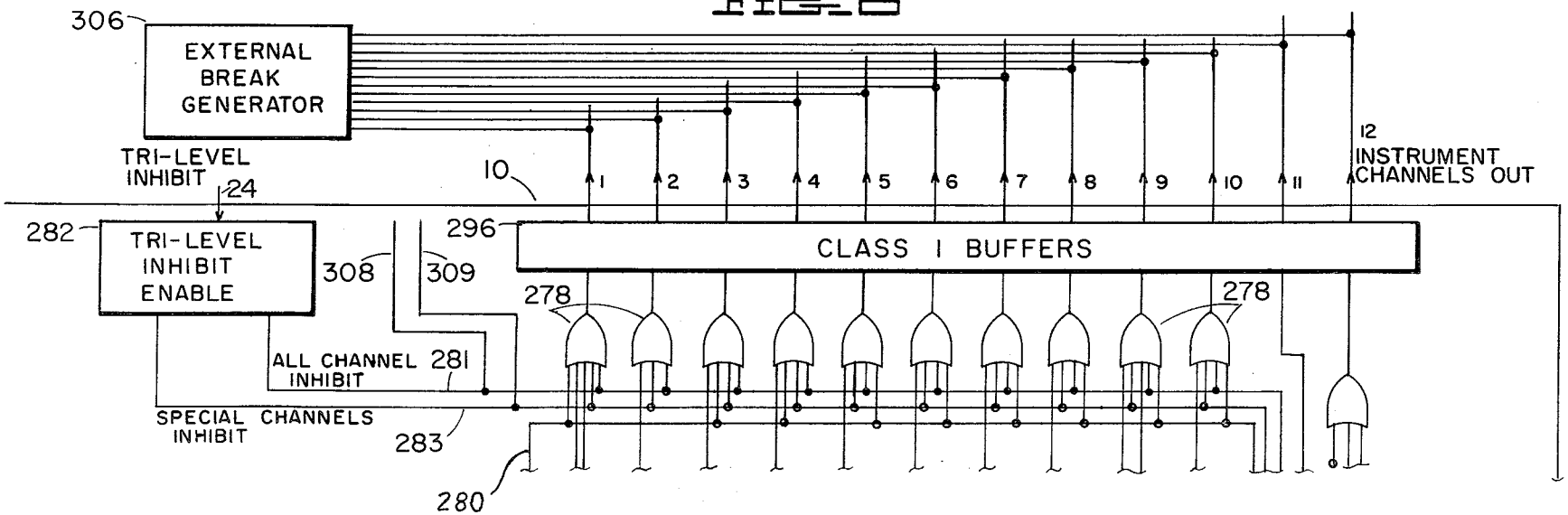
FIG. 8 is a schematic showing an external break generator connected to the output channels for the chip.

Due to the inhibiting system for the instrument channels comprising tri-level inhibit enable 282 and the inputs to OR gates 278, 291 and 295, the rhythm generator can be used in parallel with an external rhythm break generator 306 shown in FIG. 8. In this case, external break generator 306 is parallel connected with the outputs of rhythm chip 10 which are connected to the rhythm voicing block 57. When the break generator 306 is activated in some cases, it will be desirable to inhibit all the instrument channel outputs of chip 10 when the external break generator 306 is utilized, by placing the appropriate control signal on line 308 which is connected to line 281 whereas in other cases, it may be desirable to permit the bass pattern/alternating pedal, rhythm repeat and musical rhythm accompaniment outputs, and perhaps some of the rhythm instrument channels to remain enabled. To selectively disable only certain channels, the appropriate control signal is placed on line 309, which is connected to line 283.

It should be noted that the invention, in its broadest sense, is not limited to the particular circuit arrangement described above. For example, instead of utilizing a read only memory to store the rhythm patterns, other memory-type devices could be used, such as a hard wired matrix, or even a random access memory. Furthermore, the decimal read only memory 154 could be replaced by a binary read only memory, with appropriate changes made in the addressing circuitry. The term "pulse" is used in the specification and claims and should be construed in its broadest sense as a short duration change in state, as a change in voltage, current level, etc.

Rhythm voicing block 57 may comprise one of any number of the prior art rhythm voicing circuits suitable for producing sounds simulative of percussion instruments. For example, the pulses on instrument output channels V4, V5 and V6 for the brush, cymbal and snare drum, respectively, could be utilized to turn on and off the white noise source on line 66 to thereby produce the appropriate percussion instrument sounds. In order to produce the drum sounds, such as the base drum, low conga, etc. the pulses on the appropriate lines are fed to the input of a ringing circuit which produces at its output the simulative sounds.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. An electronic rhythm generator comprising:

memory means for storing a plurality of rhythm patterns and for storing a plurality of rhythm break patterns, some of said rhythm patterns being nominally programmed to be rhythmically incompatible with one set of said rhythm break patterns and nominally programmed to be rhythmically compatible with others of said rhythm break patterns, player operable select means connected to said memory for selecting a rhythm pattern and for selecting a rhythm break pattern, selectively operable rhythm pattern access means for accessing said memory means to produce a series of rhythm output signals in the selected rhythm pattern, selectively operable break pattern access means for accessing said memory means to produce a series of rhythm output signals in the selected break pattern, and override means for automatically selecting another stored break pattern which is rhythmically compatible with the selected rhythm pattern in place of the player selected rhythm break pattern in the event that the player selected rhythm break pattern is rhythmically incompatible with the selected rhythm pattern.

2. The rhythm generator of claim 1 including player operable selector switch means comprising a manually operated momentary switch means and means actuated by said selector switch means for causing said rhythm generator to remain in a break mode for a predetermined number of rhythm clock pulses generated by a rhythm clock even though said momentary switch means is released before said predetermined number of rhythm clock pulses have occurred.

3. The rhythm generator of claim 2 wherein said means actuated by said momentary switch means causes said rhythm generator to remain in the break mode at least as long as said momentary switch means is depressed.

4. The rhythm generator of claim 1 wherein said rhythm output signals are produced on a plurality of output channels, and including rhythm voice generating means connected to said rhythm output channels for generating percussive rhythm sounds in response to the rhythm pulses on said output channels, and further including inhibit means responsive to a control signal for inhibiting predetermined ones of said output channels to pass rhythm pulses to said voice generating means.

5. The rhythm generator of claim 1 wherein said player operable select means includes a plurality of selectively activated rhythm select lines, and a plurality of selectively activated rhythm break lines, and said override means comprises: a decoder connected to said selectively activated rhythm select lines for producing a control signal identifying the rhythmical meter of the selected rhythm pattern, and logic means having an input connected to receive said control signal for enabling a rhythm break line corresponding to a break pattern compatible with the selected rhythm select line.

6. The rhythm generator of claim 5 wherein said logic means comprises a plurality of interconnected electronic gates.

7. The rhythm generator of claim 1 wherein a first set of said rhythm patterns are of various rhythmical meters, said rhythm break patterns are of various rhythmical meters, and said override means automatically selects a rhythm break pattern having a rhythmical meter identical to the rhythmical meter of the selected rhythm pattern.

8. The rhythm generator of claim 7 wherein said rhythm patterns and said rhythm break patterns comprise respective rhythmical meters of 4/4 time and $\frac{3}{4}$ time.

9. The rhythm generator of claim 7 wherein said rhythm patterns and said rhythm break patterns comprise respective rhythmical meters of 4/4 time and $\frac{3}{4}$ time and 5/4 time.

10. The rhythm generator of claim 1 wherein said memory means stores an auxiliary pattern selectable by the player simultaneously with the production of pulses on the output lines in the first mentioned selected pattern, said memory responding to enabling signals on its address lines to produce output signals in the selected auxiliary pattern simultaneously with the production of pulses on the output lines in the first mentioned selected pattern.

11. The rhythm generator of claim 10 wherein the auxiliary pattern is a drum roll pattern.

12. The rhythm generator of claim 10 wherein the auxiliary pattern is a woodblock pattern.

13. The rhythm generator of claim 10 including two said auxiliary patterns, one of said auxiliary patterns being a drum roll and the other a woodblock, and player operable means for selecting one of said auxiliary patterns.

14. An electronic rhythm generator comprising:

memory means for storing a plurality of rhythm patterns, said memory means having a plurality of address lines, said memory means including a plurality of sets of output lines associated respectively with said stored patterns wherein corresponding output lines from said sets are associated with a particular rhythm instrument voice or rhythm control function, means for combining said corresponding output lines from said sets associated with the same rhythm instrument so as to form a plurality of rhythm output channels, player operated pattern select means connected to said memory means for selecting a stored rhythm pattern in said memory means, said memory means being programmed to respond to a series of enabling signals on said address lines to produce on said output lines rhythm pulses in the selected rhythm pattern, memory address means for placing a series of enabling signals on said address lines, rhythm voice generating means connected to said rhythm output channels for generating percussive rhythm sounds in response to the rhythm pulses on said output channels, inhibit means responsive to a control signal for inhibiting predetermined ones of said output channels to pass rhythm pulses to said voice generating means, a second rhythm generator having a plurality of output lines and means for generating on at least some of said lines rhythm pulses in a selected rhythm pattern, said second rhythm generator output lines being connected in parallel to said output channels whereby said second rhythm generator can produce outputs on inhibited ones of said output channels, said inhibit means comprising a plurality of electronic gates connected to respective ones of said output channels, each said gate having a first control input connected to a common first control line, some of said gates having a second control input connected to a common second control line, and said inhibit means including means for selectively placing a gate disabling signal on said first control line and means for selectively placing a gate disabling signal on said second control line whereby some of said gates or all of said gates can be disabled.

15. An electronic rhythm generator comprising:

memory means for storing a plurality of rhythm patterns and having a plurality of address lines and output channels, a plurality of player actuated rhythm pattern selector switches, multiplexer means for scanning said pattern selector switches and producing a serial data stream comprising a plurality of time slots corresponding respectively to said pattern selector switches with a switch closure pulse in a time slot corresponding to an actuated one of the pattern selector switches, pattern select means connected to said memory means and synchronized with said multiplexer means for receiving and demultiplexing the serial data stream and selecting, in response to the serial data stream, the stored rhythm pattern in said memory means corresponding to the actuated pattern selector switch, said memory means being programmed to respond to sequential enabling of said address lines to produce on said output channels rhythm pulses in the selected rhythm pattern, memory address means for sequentially enabling at least some of said address lines, rhythm voice generating means connected to said rhythm output channels for generating percussive rhythm sounds in response to the rhthym pulses on said output channels, and means for inhibiting selected ones of said output channels during the sequential enabling of said address lines, said memory means, pattern select means, memory address means and means for inhibiting are contained on a single monolithic integrated circuit chip, and said means for inhibiting includes a tri-level decoder connected to a single chip input pin.

16. An electronic rhythm generator comprising:

memory means for storing a plurality of rhythm patterns, said memory means having a plurality of address lines, said memory means including a plurality of sets of output lines associated respectively with said stored patterns wherein corresponding output lines from said sets are associated with a particular rhythm instrument voice or rhythm control function, means for combining said corresponding output lines from said sets associated with the same rhythm instrument so as to form a plurality of rhythm output channels, player operated pattern select means connected to said memory means for selecting a stored rhythm pattern in said memory means, said memory means being programmed to respond to a series of enabling signals on said address lines to produce on said output lines rhythm pulses in the selected rhythm pattern, memory address means for placing a series of enabling signals on said address lines, rhythm voice generating means connected to said rhythm output channels for generating percussive rhythm sounds in response to the rhythm pulses on said output channels, inhibit means responsive to a control signal for inhibiting predetermined ones of said output channels to pass rhythm pulses to said voice generating means, and said memory address means including a clock driven counter means producing a series of counts to control the enabling of said address lines, and including at least one output line from said address means carrying a control signal synchronized with said counter, said control signal and said series of counts produced by said counter means being independent of said inhibit means, said memory means, memory address means, and inhibit means are contained on a single monolithic integrated circuit chip and said inhibit means comprises a tri-level decoder having a single control input connected to an input pin of said chip and two outputs, and means controlled by output signals on respective said outputs for inhibiting respective combinations of said output channels.

17. An electronic rhythm generator comprising:

a memory means for storing a plurality of rhythm patterns and a plurality of rhythm break patterns, said memory means having a plurality of address lines and a plurality of output channels, player operated means connected to said memory means for selecting a said rhythm pattern and a said rhythm break pattern, player operable selector means to place said rhythm generator in either a rhythm mode or a rhythm break mode, said memory means being programmed, when said rhythm generator is in the rhythm mode, to respond to a series of enabling signals on said address lines to cyclically produce on said output channels rhythm pulses in the selected rhythm pattern, said memory means being further programmed, when said rhythm generator is in the rhythm break mode, to produce on said output channels rhythm pulses in the selected rhythm break pattern, memory address means driven by a train of rhythm clock pulses for placing a series of enabling signals on said address lines, means to foreclose predetermined ones of said output channels to rhythm pulses in the selected rhythm pattern when said rhythm generator is in the rhythm break mode, break termination means for automatically returning said rhythm generator from the rhythm break mode to the rhythm mode after a predetermined number of rhythm clock pulses have occurred while said rhythm generator is in the rhythm break mode, player operated means for disabling said rhythm generator to produce rhythm pulses on said output channels, automatic override means for overriding said means for disabling so as to permit said rhythm generator to continue to produce rhythm pulses on said output channels in the selected rhythm break pattern only until the selected rhythm break pattern is completed, and said automatic override means counting the number of rhythm clock pulses during the selected break pattern and permitting said rhythm generator to be disabled when a predetermined number of said rhythm clock pulses have been counted.

* * * * *